US009795209B2

(12) United States Patent
Rivera et al.

(10) Patent No.: US 9,795,209 B2
(45) Date of Patent: Oct. 24, 2017

(54) HANDHELD EQUIPMENT HOLDER WITH MECHANICAL LATCH

(76) Inventors: Dave Rivera, Port Jervis, NY (US); Phil Whitbeck, Johnson, NY (US)

( * ) Notice: Subject to any disclaimer, the term of this patent is extended or adjusted under 35 U.S.C. 154(b) by 487 days.

(21) Appl. No.: 11/998,125

(22) Filed: Nov. 28, 2007

(65) Prior Publication Data

US 2009/0134300 A1 May 28, 2009

(51) Int. Cl.
*A45F 5/00* (2006.01)
*A45F 5/02* (2006.01)
*B25H 3/00* (2006.01)

(52) U.S. Cl.
CPC ..... *A45F 5/02* (2013.01); *A45F 5/021* (2013.01); *B25H 3/006* (2013.01); *A45F 2200/0566* (2013.01); *A45F 2200/0575* (2013.01); *Y10T 29/49826* (2015.01)

(58) Field of Classification Search
CPC ..... Y10T 24/45356; Y10T 24/45351
USPC ..... 224/269, 670, 666, 904, 268
See application file for complete search history.

(56) References Cited

U.S. PATENT DOCUMENTS 1,677,592 A * 7/1928 Lloyd ..... F16B 45/02 24/600.9
1,678,016 A * 7/1928 Menke ..... 24/3.6
4,113,156 A * 9/1978 Brito ..... 224/666
4,319,384 A * 3/1982 Horne ..... A45F 5/02 224/269
4,464,813 A * 8/1984 Bakker et al. ..... 24/601.1
4,790,461 A * 12/1988 Stover ..... 224/241
4,821,934 A * 4/1989 Alessi et al. ..... 224/667
4,928,360 A * 5/1990 Wilbanks ..... A61F 5/3776 24/302
5,377,386 A * 1/1995 Griffith ..... A45F 3/14 224/904
5,416,955 A * 5/1995 Katsma ..... 24/588.1
6,000,108 A * 12/1999 Roan ..... 24/600.9
6,292,381 B1 * 9/2001 Neumann ..... H02J 7/34 307/48
6,315,179 B1 * 11/2001 Hillis ..... 224/268
6,325,577 B1 * 12/2001 Anderson ..... 408/241 R
6,508,390 B1 1/2003 Karpati
6,655,560 B2 * 12/2003 Kahn ..... 224/268
6,729,517 B2 * 5/2004 Grover ..... 224/575
6,848,605 B2 2/2005 Dillenberger
7,946,005 B2 * 5/2011 Lee ..... F16B 45/00 24/582.11

(Continued)

OTHER PUBLICATIONS

BiggLugg Products, Item # BL1, "Bigg Lugg 1 The Original Cordless Frill Driver Holder," Product Description found http://www.bigglugg.com/products.html, Sep. 21, 2007, 2 pgs.

(Continued)

*Primary Examiner* — Adam Waggenspack
(74) *Attorney, Agent, or Firm* — Saile Ackerman LLC; Stephen B. Ackerman; Rosemary L. S. Pike

(57) ABSTRACT

A tool holder designed for battery operated power tools is attachable to a belt and has a quick release to allow access to the power tool. The tool holder grasps the power tool at the handle between the battery pack of the tool and the housing containing the operative part. The tool holder is made of a flat material such as metal or a high-density plastic and comprises a mechanical latch that secures the power tool within the holder until the user disengages the latch to allow removal of the tool.

9 Claims, 3 Drawing Sheets

(56) References Cited

U.S. PATENT DOCUMENTS

| | | | | |
|---|---|---|---|---|
| 2004/0140336 | A1* | 7/2004 | Estabaya | 224/667 |
| 2005/0174782 | A1* | 8/2005 | Chapman | 362/319 |
| 2005/0180130 | A1* | 8/2005 | Harris et al. | 362/184 |
| 2005/0273969 | A1* | 12/2005 | Watson | A47L 5/14 15/344 |
| 2006/0107504 | A1* | 5/2006 | Ferguson et al. | 24/601.1 |
| 2006/0261116 | A1* | 11/2006 | Brandeis | 224/671 |
| 2007/0062013 | A1 | 3/2007 | Mueller | |
| 2007/0108242 | A1* | 5/2007 | Rassias | F41C 33/0236 224/243 |
| 2008/0122403 | A1* | 5/2008 | Griffin | H02J 7/0027 320/110 |
| 2009/0121550 | A1* | 5/2009 | Riviera | H02J 7/0068 307/66 |

OTHER PUBLICATIONS

Clip-Lok Belt Attachment—48-67-0150, Product Description found, Sep. 21, 2007, http://www.builderssquare.com/xp_93699-Clip_Lok_Belt_attachme, 1 pg.

* cited by examiner

HANDHELD EQUIPMENT HOLDER WITH MECHANICAL LATCH

BACKGROUND OF THE INVENTION

1. Field of Invention

The present invention is related to holding equipment and more particularly holding hand held equipment at a users side when not in use.

2. Description of Related Art

People working in the construction and repair industry often use tool belts to keep small tools close at hand when not in use. Larger tools such as nail guns and electric drills are usually too bulky to be contained by existing tool belts; and therefore those larger tools are laid aside when not in use. If the movement of the person using the larger tools takes the person out of reach of the laid down tool, then that person must stop what they are doing and retrieved the tool.

Tool belts have been favorites of people who are in construction and are building housing and commercial buildings; however these tool belts have limitations and in general are limited to smaller hand tools. U.S. Pat. No. 6,848,605 (Dillenberger) is directed to an augmentation for a tool belt wherein additional fixtures for holding tools are added to the tool belt by sliding a male portion into a female portion attached to the tool belt. U.S. Pat. No. 6,508,390 (Karpati) is directed to a belt-mounted holder for spackling items comprising horizontal portion for holding tools. U.S Patent Application 2007/0062013 (Mueller) is directed to a carabiner device comprising a handle that can carry devices around an area or as a work tool. Existing commercially are tool clips such as provided by Brigg Lugg, which have a belt clip and a bungee ball that can be wrapped around a tool such as a drill, and a Clip-Lock belt that carries a cordless drill of the same brand and can be attached or detached with a simple motion of the hand or fingers.

SUMMARY OF THE INVENTION

It is an objective of the present invention to provide a tool holder for hand held power tools.

It is further an objective of the present invention to provide the capability for the tool holder to be coupled to the wearing apparel of the user.

It is also an objective of the present invention to provide a quick release of the hand held power tool from the tool holder.

The present invention is a tool holder for holding hand held power tools at the side of a user. A flat strap like material, comprising metal or a high-density plastic, is shaped to form a belt loop and a tool loop, or pocket. The tool loop is shaped to hold a battery powered hand tool, such as a nail gun, a power hand drill and a power screwdriver, and is formed in part by the flat material and in part by mechanical latch, or gate, attached to the flat material. The mechanical latch is spring loaded to keep the tool loop closed except when the user disengages the mechanical latch by pressing a thumb bar on the mechanical latch to allow the power tool contained within the tool loop to be removed by the user. When a power tool is placed into the tool holder, the power tool is pressed against the mechanical latch by the user, which disengages the mechanical latch and allows the power tool into the tool loop. The mechanical latch is then allowed to close under the force of the spring to maintain the power tool within the tool loop, or pocket, formed by the flat material and the mechanical gate. The tool loop grasps the battery operated hand held power tool between the battery power pack and the housing containing the operational portion of the power tool.

BRIEF DESCRIPTION OF THE DRAWINGS

This invention will be described with reference to the accompanying drawings, wherein.

DETAILED DESCRIPTION OF THE PREFERRED EMBODIMENT

Figure 1:
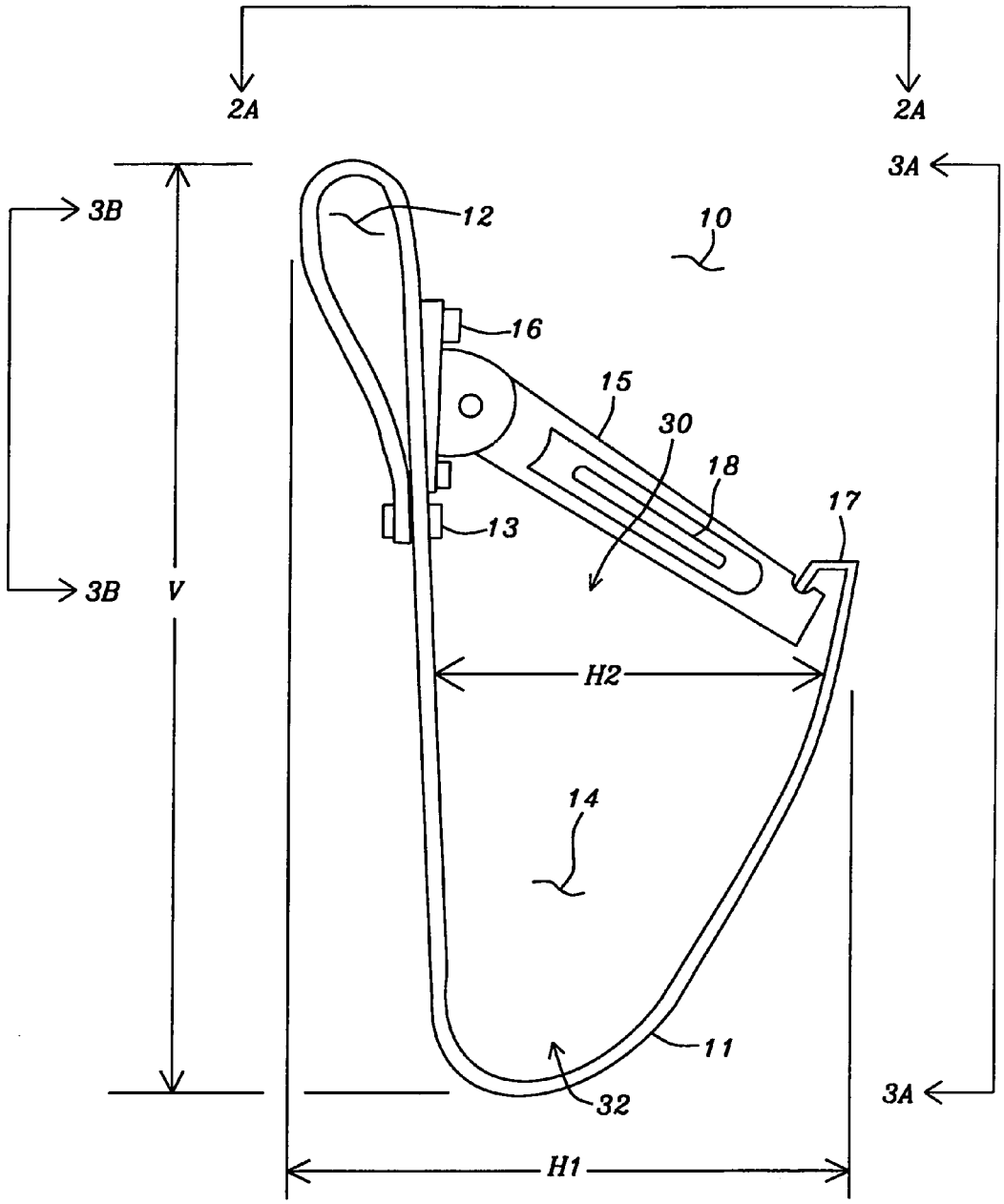
FIG. 1 is a diagram of the side view of the tool holder of the present invention.

In FIG. 1 is shown a side view of the J-shaped tool holder 10 of the present invention. The tool holder is designed to hold hand held power tools, i.e. battery powered nail guns, battery powered screwdrivers and battery powered drills or similar equipment, close to the user when the tools are not in use. A flat material 11 made from metal, high-density plastic or other matter than can maintain a formed shape is used to form the tool holder 10. The tool holder can be thought of having two portions. The first portion is a belt loop 12 in which the material has been folded back and attached with fasteners 13 to the second portion of the tool holder 10. The belt loop opening has a height greater than its width, as shown in FIG. 1. It should be noted that it is within the scope of the present invention that the tool holder is directly attached by fasteners to an existing tool belt or similar device without the need for the belt loop 12. The second portion forms a tool loop 14, or pocket, that holds the battery operated power tools when not in use.

A mechanical latch 15, or mechanical gate, is attached by fasteners 16 to the first portion that forms the belt loop 12. The arm of the mechanical latch 15 is held in contact with a male latch element 17 on the end of the second portion by a wound torsion spring 25 (FIG. 2B) to maintain a tool in the tool loop 14 while not in use. A thumb bar 18 allows a user to disengage the mechanical latch 15 with the male latch element 17 and remove the battery operated power tool from the tool loop 14.

The dimensions of the tool holder 10 are dependent upon the tools that are to be held by the user. For exemplary purposes the approximate vertical height V is approximately about nine inches, the horizontal width H1 of the tool holder is approximately about four inches and the horizontal width H2 of the tool loop 14 is approximately about three inches. The tool loop 14 continuously narrows from the mouth 30 to the rounded bottom 32. The hand held power tool is grasped by the tool loop 14 on the handle between the battery power pack and the housing of the power tool containing the operating mechanism. It should be noted that it is within the scope of the present invention that the shape and dimensions of the tool holder 10 can be adjusted depending upon the tools that are to be held within the tool loop 14 without changing the intent or claims of the present invention.

Continuing to refer to FIG. 1, with the tool holder 10 attached to a belt of the apparel of a user, a hand held power tool is placed into the mouth 30 of the tool loop 14, located adjacent to the mechanical latch 15, by pressing the tool downwardly on and past the arm of the mechanical latch 15 after which the arm of the mechanical latch 15 is allowed to return to a closed position under the force of the spring 25 in contact with the male latch element 17. The power tool is now contained within the rounded bottom portion 32 of the tool loop 14. To remove a power tool from the tool loop, the user presses the thumb bar 18, which disengages the mechanical latch 15 from the male latch element and allows the power tool to be removed from the tool holder 10.

Figure 2A:
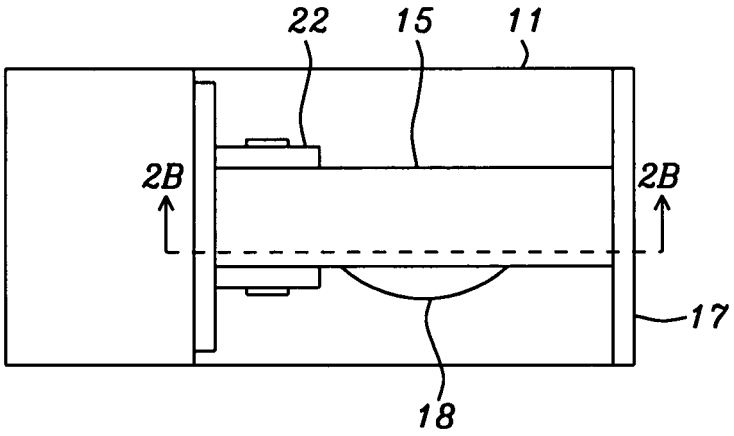
FIG. 2A is a top view of the tool holder of the present invention.
Figure 2B:
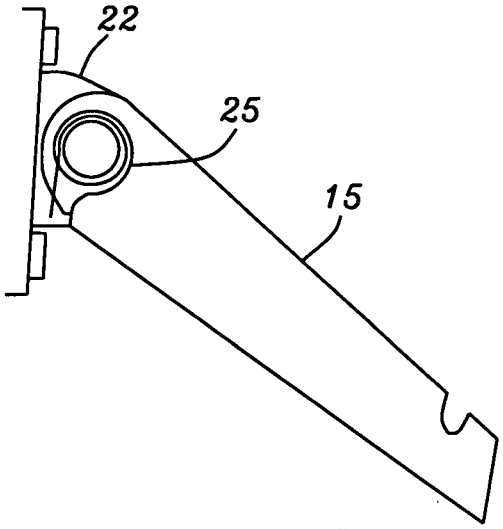
FIG. 2B is a cut a way view of the mechanical latch mechanism of the present invention.

In FIG. 2A is show a top view of the tool holder 10. The arm of the mechanical latch 15 is shown in contact with the male latch element 17 at the end of the second portion of the tool holder 10. The thumb bar 8 is shown coupled to one side of the arm of the mechanical latch 15. It should be noted that the thumb bar 18 can be on either or both sides of the arm of the arm of the mechanical latch to accommodate both right handed and left handed users. The mechanical latch 15 is coupled to a housing 22 that allows to the arm of the mechanical latch to pivot. The housing is attached to the first portion of the tool holder as previously described. FIG. 2B shows a cross section of the arm of the mechanical latch 15 and the housing 22. A spring 25 is shown that maintains the arm of the mechanical latch 15 in contact with the male latch element 17 except when overridden by the user when inserting a tool in the tool loop or removing a tool from the tool loop.

Figure 3A:
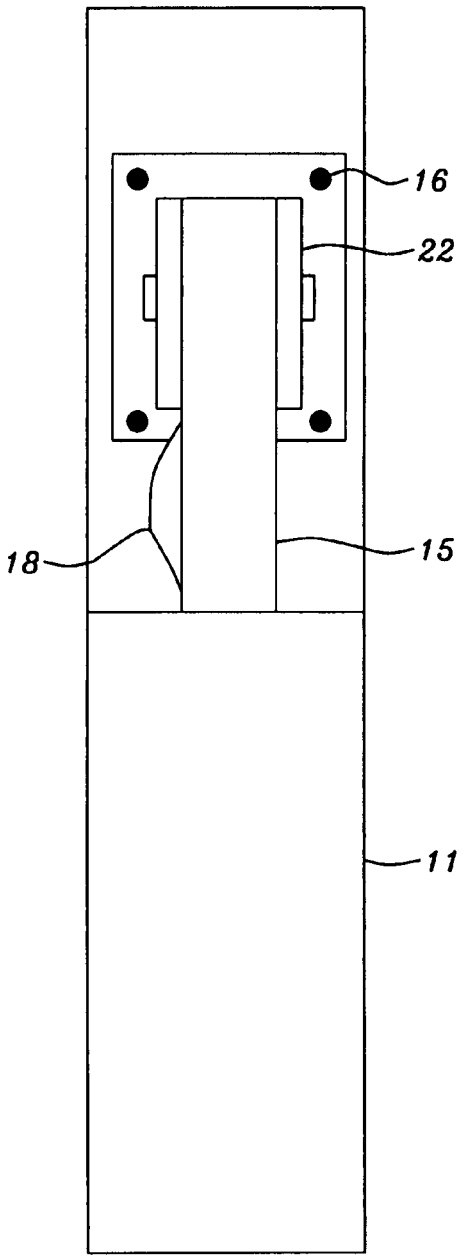
FIG. 3A is a front view of the tool holder of the present invention.
Figure 3B:
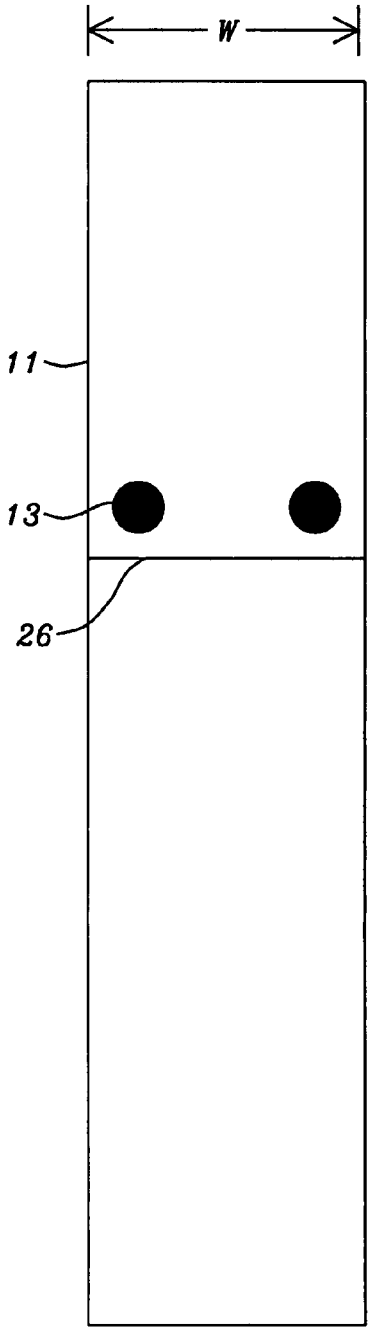
FIG. 3B is a back view of the tool holder of the present invention.

FIG. 3A shows a front view of the tool holder 10. The housing 22 that allows the arm of the mechanical latch 15 to rotate is attached to the front part of the first portion of the tool loop, which forms the belt loop 12, using fasteners 16. FIG. 3B shows the back view of the tool holder 10 where the end of the material 26 in the first portion that forms the belt loop is connected with fasteners 13 to the material of the second portion, which forms the tool loop 14. The width W of the material forming the tool holder 10 can be any dimension that is wide enough to accommodate the housing 22 of the mechanical latch and grasp the power tool between the battery power pack and the housing containing the operative mechanism of the power tool. It should be noted that the tool holder 10 can be used with any tool in which a portion of that tool can be held by the tool loop in part or in total, with and without a battery power pack.

While the invention has been particularly shown and described with reference to preferred embodiments thereof, it will be understood by those skilled in the art that various changes in form and details may be made without departing from the spirit and scope of the invention.

What is claimed is:

1. A holder for hand held power tools comprising;

a) a means for connecting a tool holder to a belt of a user worn around the waist;

b) a J-shaped pocket for grasping a handle of the hand held power tool, and an arm of a mechanical latch for closing the pocket, wherein said J-shaped pocket is formed from a thin flat strap shaped material, wherein the material is wider than the material is thick, forming a rectangular cross section, wherein the hand held power tool can be held close to the user when said hand held power tool is not in use, and wherein a mouth of said J-shaped pocket is wider than a rounded bottom portion of said pocket and wherein said pocket continuously narrows from said mouth to said rounded bottom; and c) a means for disengaging the arm of the mechanical latch located adjacent to said mouth from a male latch element to open said tool holder for removal of said hand held power tool from said pocket wherein said arm of the mechanical latch is spring loaded to keep the pocket closed.

2. The holder of claim 1 wherein the means for connecting the tool holder to said belt is a belt loop formed at an end of the tool holder wherein the belt loop opening has a height greater than its width.

3. The holder of claim 1 wherein means for disengaging the arm of the mechanical latch is a thumb bar integrally coupled to the mechanical latch, wherein the thumb bar when pressed by a user directly actuates said arm of the mechanical latch to disengage said mechanical latch from the male latch element and allows removal of the hand held power tool from the pocket.

4. A tool holder comprising:

a) an apparatus configured to hold a battery powered hand held power tool close to an operator when the hand held power tool is not in use;

b) said apparatus comprises a J-shaped body and a mechanical latch;

c) said J-shaped body formed from a thin flat strap shaped material, wherein the material is wider than the material is thick, forming a rectangular cross section, and said apparatus further comprises:

(i) a belt loop to attach said apparatus to a belt worn by the operator around the waist, wherein the belt loop opening has a height greater than its width;

(ii) a pocket shaped to grasp said power tool between a battery power pack and an operational housing and to hold the hand held power tool wherein a mouth of said pocket is wider than a rounded bottom portion of said pocket and wherein said pocket continuously narrows from said mouth to said rounded bottom;

(iii) an arm of said mechanical latch capable of maintaining the hand held power tool in the pocket until needed by the operator, wherein said arm of the mechanical latch is spring loaded to keep the pocket closed;

(iv) a male latch element at one end of said pocket wherein said mouth is located adjacent to said male latch element; and d) said arm of the mechanical latch is configured to be opened when:

(i) the power tool is pressed downwardly against the arm of the mechanical latch to insert the power tool into the pocket; or (ii) the arm of the mechanical latch is pressed by the operator to disengage the male latch element from the arm of the mechanical latch to remove the power tool from the pocket.

5. The tool holder of claim 4, wherein said belt loop is formed from a first portion of a material used to form said apparatus, wherein the first portion forms the belt loop fastened to the material of a second portion of the material forming the pocket of said apparatus.

6. The tool holder of claim 5, wherein said apparatus is formed from a metal material or a high-density plastic material.

7. The tool holder of claim 1, wherein said hand held power tool comprises:

a) a battery powered nail gun;

b) a battery powered drill; or c) a battery powered screw driver.

8. The tool holder of claim 4, wherein the arm of the mechanical latch is integrally coupled to a thumb bar to directly actuate said arm of the mechanical latch to disengage the male latch element from the arm of the mechanical latch.

9. The tool holder of claim 4 or 1, wherein said spring is a wound torsion spring.

* * * * *